US007403169B2

(12) United States Patent
Svensson et al.

(10) Patent No.: US 7,403,169 B2
(45) Date of Patent: Jul. 22, 2008

(54) ANTENNA DEVICE AND ARRAY ANTENNA

(75) Inventors: Bengt Svensson, Mölndal (SE); Anders Höök, Hindås (SE); Joakim Johansson, Töllsjö (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 209 days.

(21) Appl. No.: 10/584,907

(22) PCT Filed: Dec. 27, 2004

(86) PCT No.: PCT/SE2004/002011

§ 371 (c)(1),
(2), (4) Date: Jun. 29, 2006

(87) PCT Pub. No.: WO2005/064748

PCT Pub. Date: Jul. 14, 2005

(65) Prior Publication Data

US 2007/0126648 A1 Jun. 7, 2007

(30) Foreign Application Priority Data

Dec. 30, 2003 (WO) ..... PCT/SE03/02102

(51) Int. Cl.
*H01Q 13/10* (2006.01)

(52) U.S. Cl. ..... 343/767; 343/770; 343/771

(58) Field of Classification Search ..... 343/767, 343/770, 771, 747, 786, 859, 865
See application file for complete search history.

(56) References Cited

U.S. PATENT DOCUMENTS 4,853,704 A * 8/1989 Diaz et al. ..... 343/767
5,519,408 A * 5/1996 Schnetzer ..... 343/767
5,748,153 A * 5/1998 McKinzie et al. ..... 343/767
6,043,785 A * 3/2000 Marino ..... 343/767
6,239,761 B1 * 5/2001 Guo et al. ..... 343/767
6,292,153 B1 * 9/2001 Aiello et al. ..... 343/767

FOREIGN PATENT DOCUMENTS

EP 0 455 493 11/1991

(Continued)

OTHER PUBLICATIONS

International Search Report for PCT/SE04/02011 dated Apr. 18, 2005.

(Continued)

*Primary Examiner*—Shih-Chao Chen
(74) *Attorney, Agent, or Firm*—Nixon & Vanderhye, P.C.

(57) ABSTRACT

The present invention relates to a broadband non-resonant antenna device for wireless transmission of information using electromagnetic signals, comprising a metal sheet layer, forming a plane, with a slotline that comprises a first part and a second part. The side of the second part that is the most distant from the first part transcends into a widening open-ended tapered slot in the metal sheet layer. The device additionally comprises a feeding line in the metal sheet layer. The feeding line comprises a feeding part, with a first end and a second end, and gaps separating the feeding part from the surrounding metal sheet layer by a certain distance, where the slotline is intersected by the feeding line.

23 Claims, 13 Drawing Sheets

FOREIGN PATENT DOCUMENTS

FR 2 691 014 11/1993

OTHER PUBLICATIONS

Wu et al., *Coplanar Waveguide Feed Linear Tapered Slot Antenna*, Proceedings of the IEEE Antennas and Propagation International Symposium, part 1 of 2, Jun. 28-Jul. 2, 1993, vol. 1, pp. 364-367.

Patent Abstracts of Japan, vol. 1998, No. 1, Jan. 30, 1998, for JP 09-246849, Sep. 19, 1997.

Schaubert et al., *Wideband Vivaldi Arrays for Large Aperture Antennas*, Proceedings of the Conference held at the Astron Institute, Apr. 12-14, pp. 49-57.

Dufrêne et al., *Linear Antenna Array with Radiators in the Form of a Tapered Slot*, Proceedings of the 14th International Conference on Microwaves, Radar and Wireless Communications, MIKON-2002, 2002, vol. 1, pp. 222-225.

* cited by examiner

ANTENNA DEVICE AND ARRAY ANTENNA

This application is the US national phase of international application PCT/SE2004/002011 filed 27 Dec. 2004, which designated the U.S. and claims priority to PCT/SE2003/002102 filed 30 Dec. 2003, the entire content of each of which is hereby incorporated by reference.

TECHNICAL FIELD

The present invention relates to a broadband non-resonant antenna device for wireless transmission of information using electromagnetic signals, comprising a metal sheet layer, forming a plane, with a slotline that comprises a first part and a second part, where the side of the second part that is the most distant from the first part transcends into a widening open-ended tapered slot in the metal sheet layer.

The present invention also relates to an antenna array comprising a plurality of said antenna devices.

BACKGROUND ART

In systems for wireless transmission of information using electromagnetic signals, for example radar and cellular telephony or some other telecommunication area, there is a strong need for efficient antennas, both single antennas and group or array antennas. For different applications, different types of antennas with different properties are desired. For many applications, broadband properties are desired.

When an antenna element is used in an array, i.e. when a number of antenna elements are placed in a horizontal row or a vertical column, the antenna element may be fed with varying phase, which results in that the main lobe of the array antenna radiation pattern may be directed in different directions along the array. A two-dimensional array may also be used, where a number of antenna elements are placed in horizontal rows and vertical columns. The elements may then be fed with varying phase along both the horizontal rows and the vertical columns allowing the main lobe of the array antenna radiation pattern to be directed in different horizontal and vertical directions along the array. These "steerable" arrays are also called phased arrays.

Antenna elements may also be arranged in orthogonally arranged pairs, radiating in orthogonal directions. These antennas are called dual polarized antennas. An array antenna may thus be dual polarized if it consists of an equal amount of orthogonally arranged pairs of antenna elements. One reason for using a dual polarized antenna is that so-called polarisation diversity is desired. Polarisation diversity is for example desired when there is a risk that the antenna signal is reflected in such a way that the main signal and the reflected signal have opposite phases at the point of reception, causing the signal to fade out. If two polarizations are used, the risk of fading decreases as both polarizations would have to fade at the same time.

One kind of non-resonant antenna element which typically is used when a wide broadband performance is desired, i.e. when a performance over a wide frequency span is desired, is the so-called notch antenna, which is a kind of a so-called end-fire element. Also, when used in an array antenna, the use of notch antenna elements allows the array antenna to be directed to scan wide angles. Especially, the use of a tapered notch antenna element is preferred, which basically comprises a slot in a metal layer, which slot widens as it approaches an edge of the metal layer.

One special kind of a tapered notch antenna element is the so-called Vivaldi notch antenna element, which may be used alone or in an array.

A typical tapered notch antenna element may be formed on a first copper-clad substrate, for example a PTFE-based substrate, where the copper on one side, the feeding side, has been etched away but for a single feeding microstrip line. On the other side of the substrate, a slot is formed in the copper, which slot starts to widen as it approaches an edge of the substrate, forming a tapered slot. The tapering is typically represented by an exponential form. The microstrip feeding line passes the slot on the other side of the substrate in such a way that the longitudinal extension of the microstrip feeding line is essentially perpendicular to the longitudinal extension of the slot. The microstrip feeding line passes the slot approximately with the length $\lambda_g/4$, i.e. one quarter of a wavelength in the material, a so called guide wavelength, if the feeding line is open-ended. The open-ended feeding line transforms to a short-circuited feeding line under the slot due to the $\lambda_g/4$ length. The microstrip feeding line then couples energy to the slot, as the electromagnetic field of the microstrip feeding line is interrupted by the slot.

This design is, however, asymmetrical when looking towards the edge of the laminate where the tapered slot emerges, as there is a feeding line on one side of the laminate and a tapered slot structure on the other side. This asymmetry may result in cross-polarization at the antenna radiation pattern. One way to come to terms with this asymmetry is to mount a second laminate, without copper on one side and with an essentially identical tapered slot structure on the other side, to the first laminate in such a way that the side without copper on the second laminate faces the side with the microstrip feeding line on the first substrate. In this way the feeding line is squeezed between the two laminates, forming a stripline feeding line, with essentially identical tapered slots etched out of the copper cladding on the outer sides, forming a dual-sided notch antenna.

The basic configuration of a tapered slot antenna element of the Vivaldi type is described in the technical article "Wideband Vivaldi arrays for large aperture antennas" by Daniel H. Shaubert and Tan-Huat Chio. There the $\lambda_g/4$ length is made as a so-called radial stub in order to achieve a larger bandwidth. The other end of the slot, opposite to the tapered part of the slot, is ended with a circular part without copper, forming a two-dimensional cavity which results in an open-ended slot line close to the feeding point. The article also describes how array antennas may be formed using a Vivaldi antenna element. A problem with this symmetrical Vivaldi antenna element design is that so-called parallel plate modes appear in the substrate material, i.e. undesired propagation of electromagnetic radiation. In order to suppress these parallel plate modes, metallic posts, vias, have to connect the copper on the outer sides of the laminates, surrounding the tapered slot structure.

This dual sided tapered slot antenna with vias for mode suppression ends up in a rather complicated substrate configuration, especially in an array configuration. The use of substrates renders dielectric losses and also makes the final antenna quite heavy. The use of substrate materials is also disadvantageous when an antenna is meant to be used for space applications, i.e. in a satellite, as electrostatic build-ups in the plastic material may result in discharges that could be fatal for adjacent electronic circuits. The common PTFE substrates are also relatively expensive.

U.S. Pat. No. 5,142,255 describes co-planar waveguide filters etched on a substrate, which filters may be combined with a notch antenna which is fed by active components. This is however a quite narrow-banded structure, as the co-planar waveguide filters are resonant for certain narrow frequency bands. The active components may also affect the bandwidth of the structure.

Neither of the documents above disclose how a broadband, symmetrical tapered slot antenna element that does not have to be supported by a substrate may be devised.

DISCLOSURE OF INVENTION

It is an object of the present invention to provide an antenna device and manufacturing method by means of which the above-mentioned problem can be solved, in particular for providing a tapered slot antenna element, that does not have to be supported by a substrate, and that also is symmetrical.

This object is achieved by means of an antenna device as initially mentioned, in which the device additionally comprises a feeding line in the metal sheet layer, which feeding line comprises a feeding part, with a first end and a second end, and gaps separating the feeding part from the surrounding metal sheet layer by a certain distance, where the slotline is intersected by the feeding line.

This object is also achieved by means of an array antenna device, where at least one of the included antenna devices has the features described in any one of the appended claims 1-12.

Preferred embodiments of the present invention are described in the dependent claims.

Examples of advantages that are obtained by means of the present invention are:

- A symmetrical antenna structure, thus lowering the cross-polarization level.
- Low losses, as no substrate is used.
- Simple construction, allowing a cost-effective manufacture, especially for dual polarized two-dimensional phased array antennas.
- Coherent rows and columns may be joined together and form a self-supporting structure.
- Lightweight as only a single metal layer is used for the antenna element.
- Active modules adapted for reception and/or transmission may be connected to the antenna elements by being fit in the spaces between the antenna elements in a dual polarized array antenna configuration, allowing the antenna structure to act as a cooling flange for the active modules.
- An additional advantage is that no static charge build-up will occur, as only a single metal layer and no dielectrics are used for the antenna element.

BRIEF DESCRIPTION OF DRAWINGS

The present invention will now be described more in detail with reference to the appended drawings, where.

MODES FOR CARRYING OUT THE INVENTION

Figure 1:
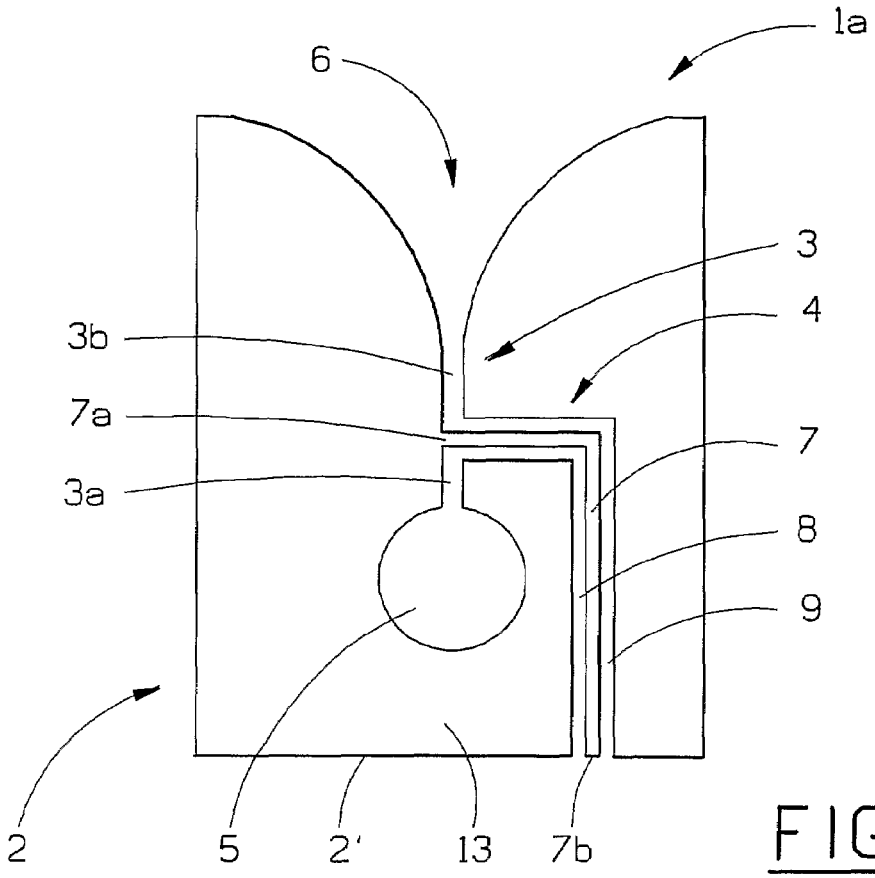
FIG. 1 shows a schematic front view of a first embodiment of an antenna element with a feed line according to the invention.

In FIG. 1, a schematic view of an antenna device in the form of a tapered slot antenna element 1*a*, for example of the "Vivaldi" type, is shown. The tapered slot antenna 1*a* comprises a metal layer 2 with a slotline 3 having a first part 3*a* and a second part 3*b*, which slotline 3 is fed by a feed line 4. An essentially two-dimensional slot cavity 5 terminates the first part 3*a* of the slotline 3. The second part 3*b* of the slotline 3 transcends into an open-ended tapered slot 6, thus forming a radiating element. The tapered slot antenna element 1*a* is made from only one single metal layer 2, forming a ground plane, where the feed line 4 is incorporated in this metal layer. The feed line is of the type co-planar waveguide (CPW), which comprises a feeding part 7 in the form of a centre conductor 7 separated from the surrounding ground plane 2 by gaps 8, 9. The feed line 4 and its centre conductor 7 intersects the slotline 3, dividing it into the first part 3*a* and the second part 3*b*. This type of transmission line is essentially a TEM (transverse electric and magnetic field) transmission line, similar to a coaxial line. The use of this CPW feed 4 makes it possible to manufacture both the feed line 4 and the tapered slot 6 in the same metal layer 2, which may be a sheet of metal, forming a metal sheet layer 2.

The centre conductor 7 of the feed line 4 has a first end 7*a* and a second end 7*b*, which first end 7*a* intersects the slotline 3. The second end 7*b* run towards an edge 2' of the metal sheet layer 2. The first end 7*a* may end in many ways, it may end short-circuited as shown for the antenna element 1*a* in FIG. 1, i.e. connected directly to the ground plane 2 directly after having passed the slotline 3, dividing it into the two parts 3*a*, 3*b*.

Figure 2:
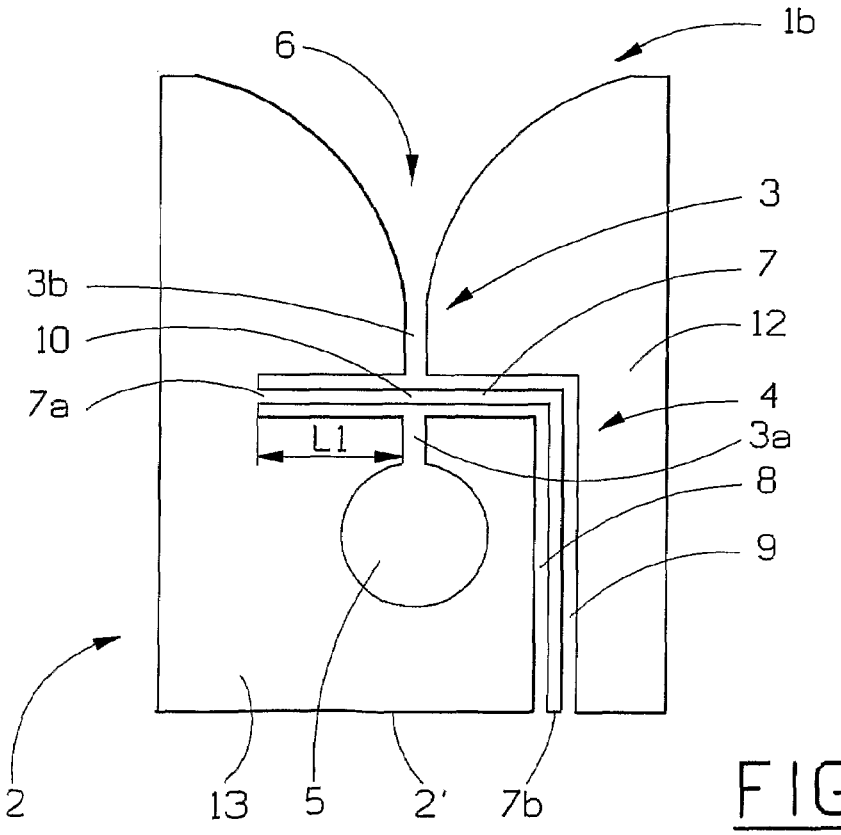
FIG. 2 shows a schematic front view of a second embodiment of an antenna element with a feed line according to the invention.

In FIG. 2, a tapered slot antenna element 1*b* is shown where the centre conductor 7 passes the slotline 3 with the length L1, dividing the slotline 3 into the two parts 3*a*, 3*b*. The passing length L1 of the centre conductor 7 approximately equals $\lambda_g/2$, i.e. one quarter of a wavelength in the material, a so called guide wavelength, where the wavelength corresponds to the centre frequency of the antenna frequency band, and the centre conductor 7 is short-circuited at its end point 7*a*, resulting in that the short-circuited centre conductor 7 transforms back to be short-circuited at the slot feed point 10 as well.

Figure 3:
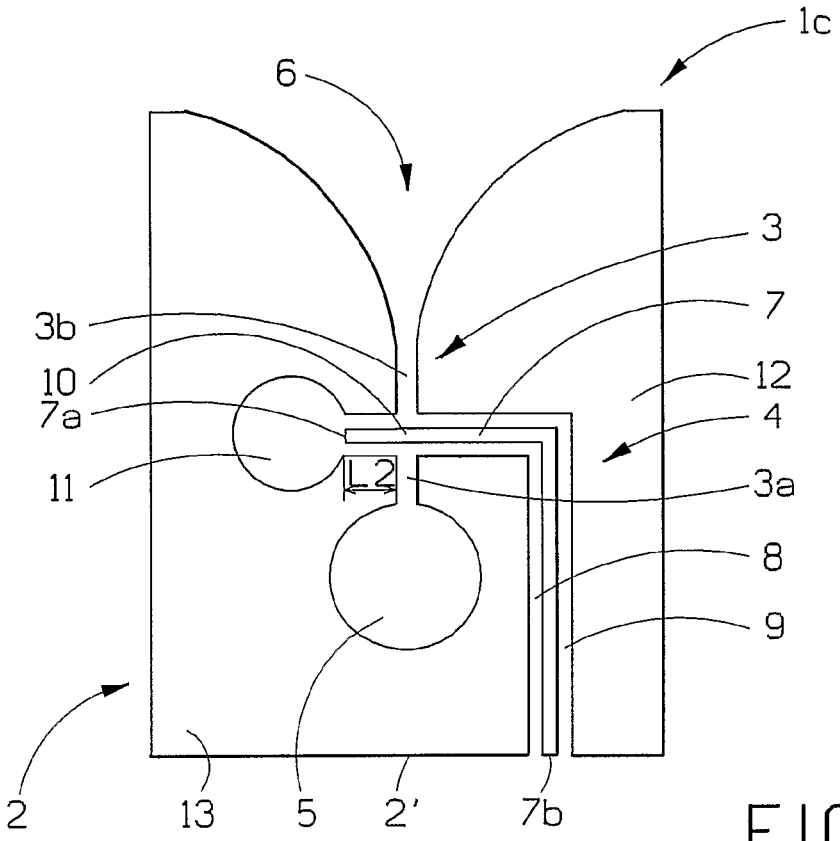
FIG. 3 shows a schematic front view of a third embodiment of an antenna element with a feed line according to the invention.

In FIG. 3, a tapered slot antenna element 1*c* is shown where the centre conductor 7 passes the slotline 3, dividing it into the two parts 3*a*, 3*b*. The passing length L2 of the centre conductor 7 approximately equals $\lambda_g/4$, and the centre conductor 7 is open-ended at its end point 7*a* where it passes into a two-dimensional feed cavity 11, similar to the slot cavity 5 which terminates the slotline 3 in its end that is most distant to the tapered slot 6. Hence the open-ended centre conductor 7 transforms to be short-circuited at the slot feed point 10.

Figure 4:
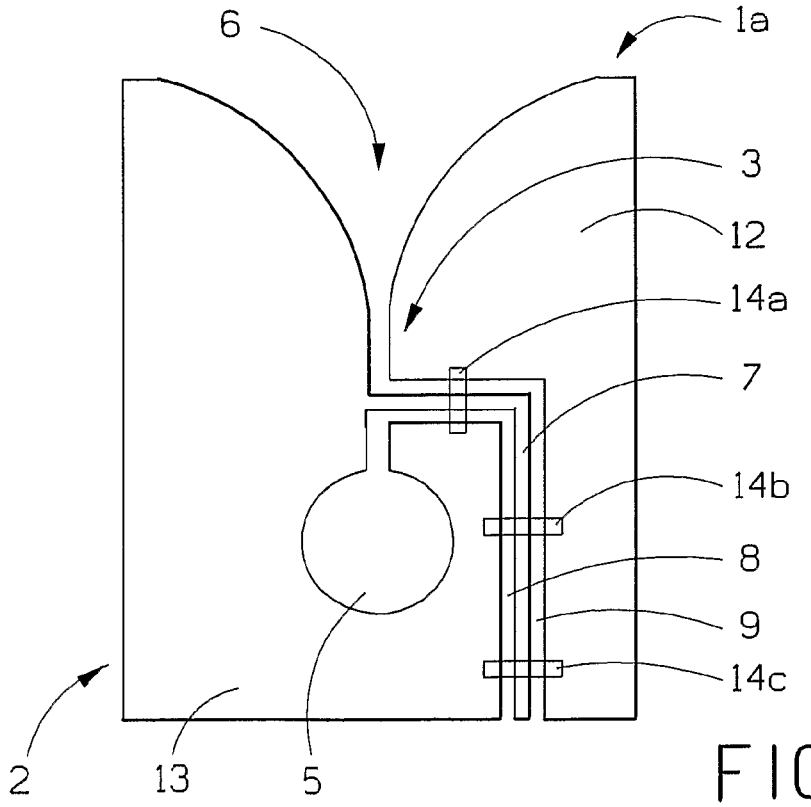
FIG. 4 shows a schematic front view of the first embodiment equipped with retainers.

The manufacture of such an antenna element 1*a*, 1*b*, 1*c* may be accomplished by means of punching of a metal sheet. Since the metal sheet 2 then will be divided in two separate parts 12, 13, it may be necessary to mechanically support the structure at some positions in order to maintain the overall structure and function of the antenna element 1*a*, 1*b*, 1*c* as illustrated with the antenna element 1*a* in FIG. 4, where the embodiment according to FIG. 1 is shown. In the embodiment according to FIG. 3, the centre conductor 7 will constitute a separate part which will have to be supported in the same way in relation to the rest of the structure. The supporting as shown in FIG. 4 is preferably done at "non-critical" positions, i.e. the supporting metal or plastic retainers 14*a*, 14*b*, 14*c* should be placed where they do not affect the electrical field in any evident way. Either the material of the retainers 14*a*, 14*b*, 14*c* is chosen to have such dielectric properties that it does not affect the electrical performance, or else the feeding line 4 is matched to adapt to the retainers 14*a*, 14*b*, 14*c*. Further, the retainers 14*a*, 14*b*, 14*c* may also for example form bridges (not shown) between the two parts 12, 13, avoiding the centre conductor 7, and may then be made of a metal.

Figure 5A:
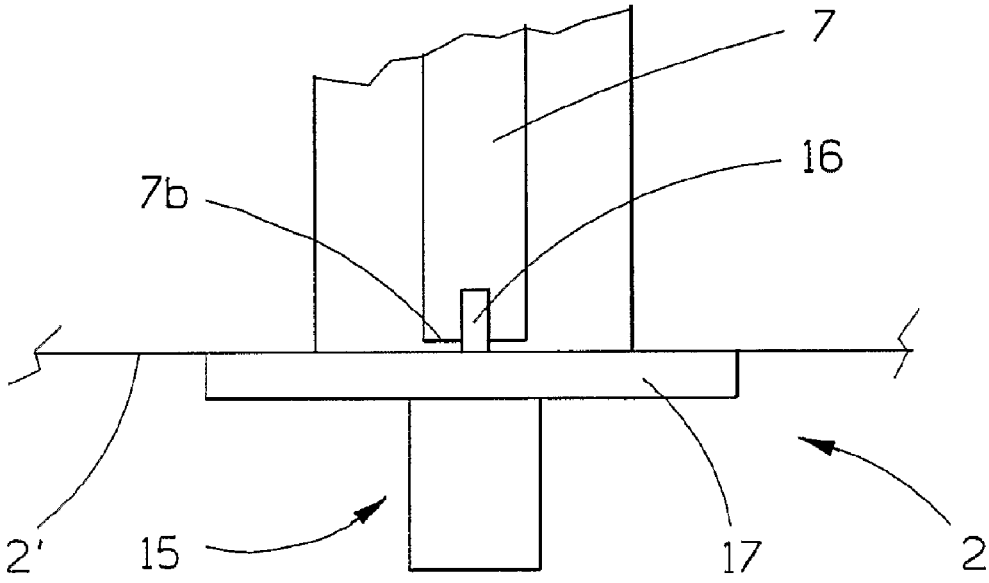
FIG. 5*a* shows a schematic front view of a first connector arrangement.
Figure 5A:
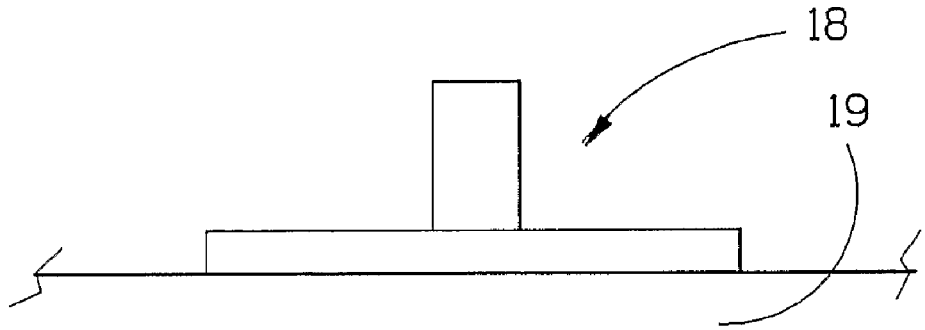

The centre conductor 7, ending at one edge 2' of the metal sheet 2 as shown in detail in FIG. 5*a*, may be connected to any appropriate external feeding. Some kind of connector 15, for example an SMA connector (a screw mounted type of RF connector) or an SMB connector (a snap-fit type of RF connector) may be used. The inner conductor 16 of the connector 15 is mounted to the second end 7*b* of the centre conductor 7 by means of for example soldering, and the outer conductor 17 of the connector 15, i.e. its ground, is mounted to the metal sheet ground plane 2, also by means of for example soldering. A corresponding connector 18 is mounted to an external feeding 19, for example a distributing feeding network.

Figure 5B:
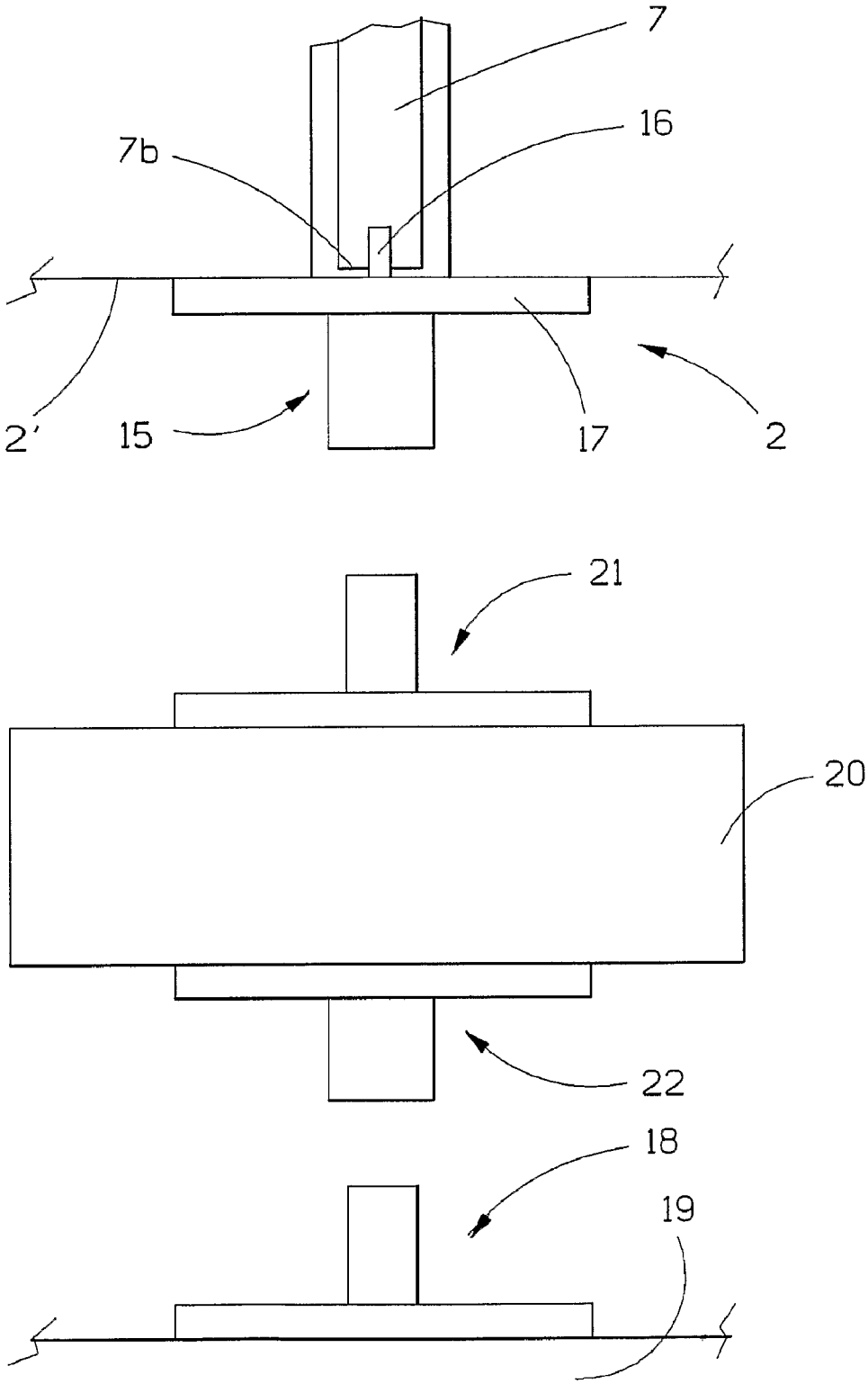
FIG. 5*b* shows a schematic front view of a second connector arrangement.

In FIG. 5*b*, a feeding module 20 adapted for reception and/or transmission, for example a so-called T/R module (transmit/receive module), is placed between the antenna and the external feeding via intermediate connectors 21, 22, which feeding module 20 for example may be of an active, i.e. comprising amplifying units, or a passive type. The feeding module 20 may also comprise variable phase-shifters and power attenuators. The feeding module 20 may be connected to a control unit (not shown) for power and phase control. The co-planar waveguide feed that is used, is also convenient for direct integration with a feeding module 20, omitting the first pair of connectors 17, 21 in FIG. 5*b*. The feeding modules 20 may also be a part of the external feeding 19, which then constitutes a feeding module in itself.

Figure 6:
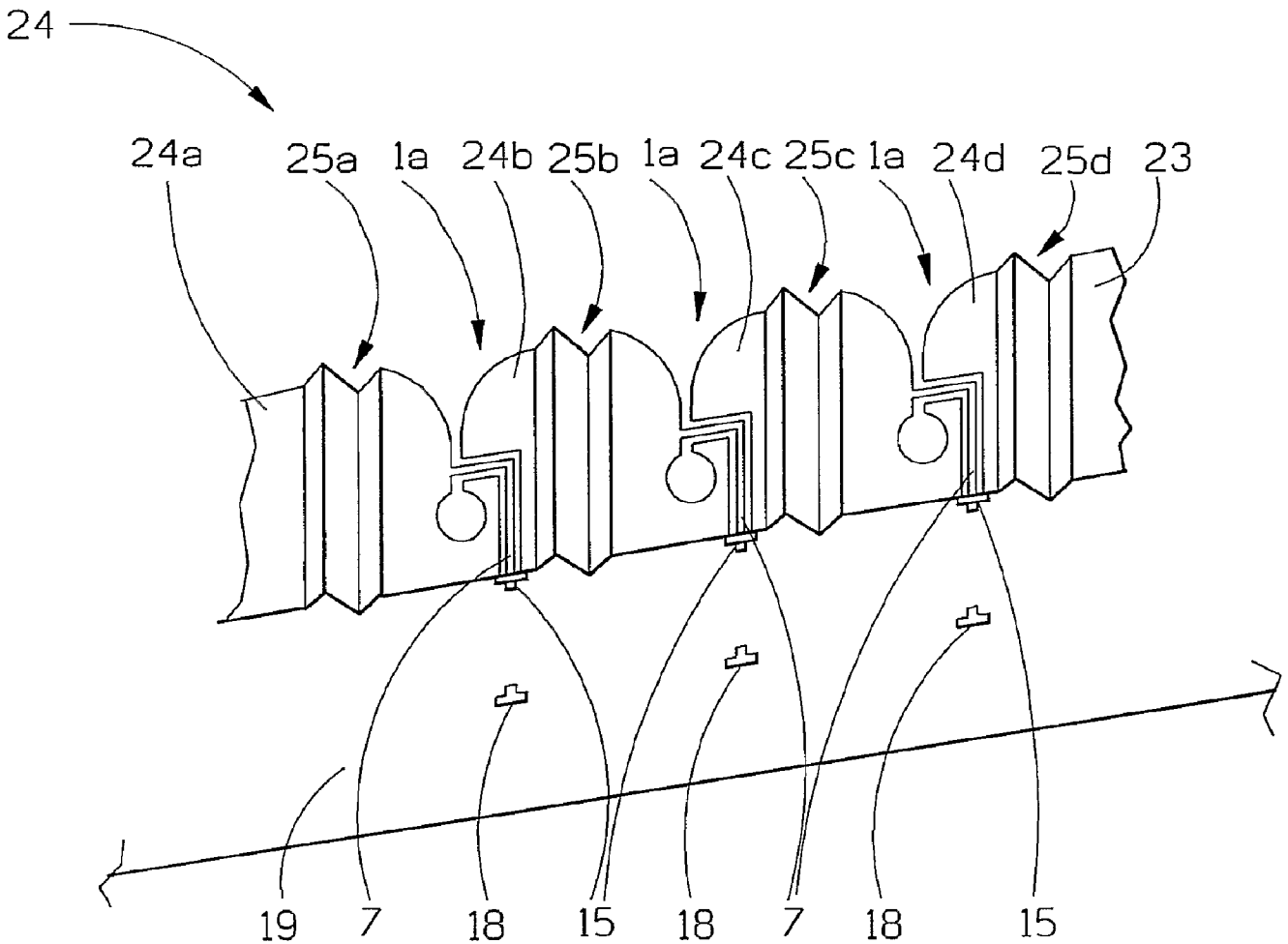
FIG. 6 shows a schematic perspective view of a one-dimensional array antenna with feed lines according to the invention.

By punching a plurality of antenna elements from a longer rectangular sheet of metal 23, a one-dimensional array antenna 24, as shown in FIG. 6, consisting of several of the antenna element 1*a* described above may be manufactured, which array antenna 24 may have centre conductors 7 with appropriate connectors 15 attached at their edges as described above. These connectors 15 may then be attached to corresponding connectors 18 mounted at an external feeding 19, for example a distribution network. Intermediate feeding modules 20 as shown in FIG. 5*b* (not shown in FIG. 6), or modules integrated in the external feeding 19, may also be used, which modules may be adapted to feed the antenna elements 1*a* in the array antenna 24 in such a way that the main lobe of the array antenna radiation pattern may be directed in different directions along the array. In order to make the array antenna more stable, the sheet may be bent, forming small corresponding indents 25*a*, 25*b*, 25*c*, 25*d*, as shown in FIG. 6.

The array antenna 24 showed in FIG. 6 is equipped with antenna elements 1*a* with a CPW feeding line according to the embodiment shown in FIG. 1. Of course, any one of the antenna elements 1*a*, 1*b*, 1*c* with their respective CPW feeding embodiments described above with reference to the FIGS. 1-3 may be used here and in the following array antenna examples, where the embodiment according to FIG. 1 with the tapered slot antenna element 1*a* is shown. The retainers 14*a*, 14*b*, 14*c* described in association with FIG. 4 may wherever necessary be applied in any appropriate way in this and the following antenna embodiment examples.

Figure 7:
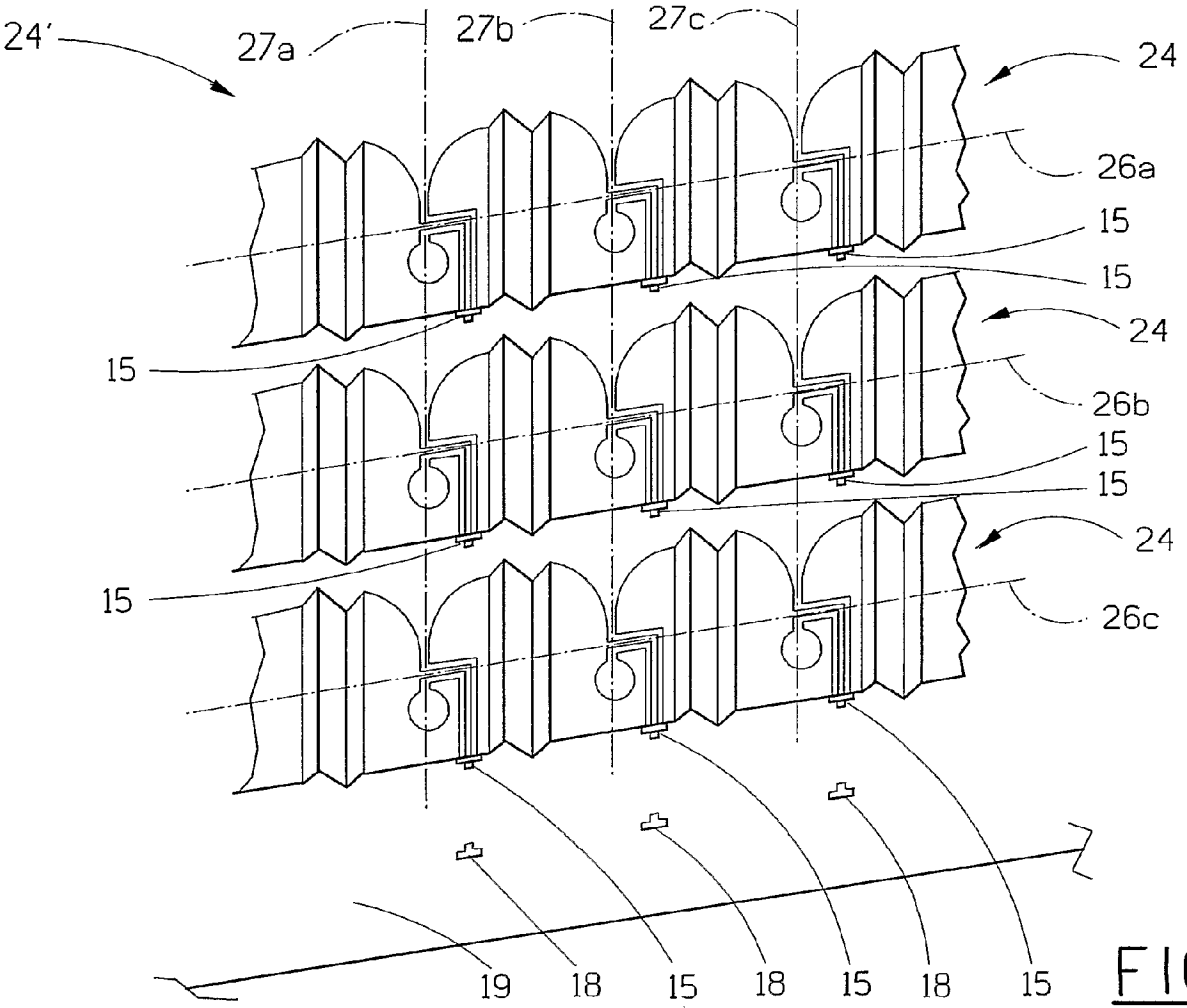
FIG. 7 shows a schematic perspective view of a two-dimensional array antenna with feed lines according to the invention.

By placing a plurality of array antennas 24 according to the above beside each other, a two-dimensional array antenna 24' consisting of rows 26*a*, 26*b*, 26*c* and columns 27*a*, 27*b*, 27*c* may be obtained, as shown in FIG. 7. The rows 26*a*, 26*b*, 26*c* may have different displacement relative to each other depending on the desired radiation properties. As described in the above, this plurality of array antennas 24 are connected to an external feeding 19 via appropriate connectors 15, 18, where the external feeding 19 may be a distribution net. Intermediate feeding modules as shown in FIG. 5*b* (not shown in FIG. 7), or modules integrated in the external feeding 19, may also be used, which modules may be adapted to feed the antenna elements 1*a* in the two-dimensional array antenna rows 26*a*, 26*b*, 26*c* and columns 27*a*, 27*b*, 27*c* in such a way that the main lobe of the array antenna radiation pattern may be directed in different directions along the array antenna rows 26*a*, 26*b*, 26*c* and columns 27*a*, 27*b*, 27*c*.

Figure 8A:
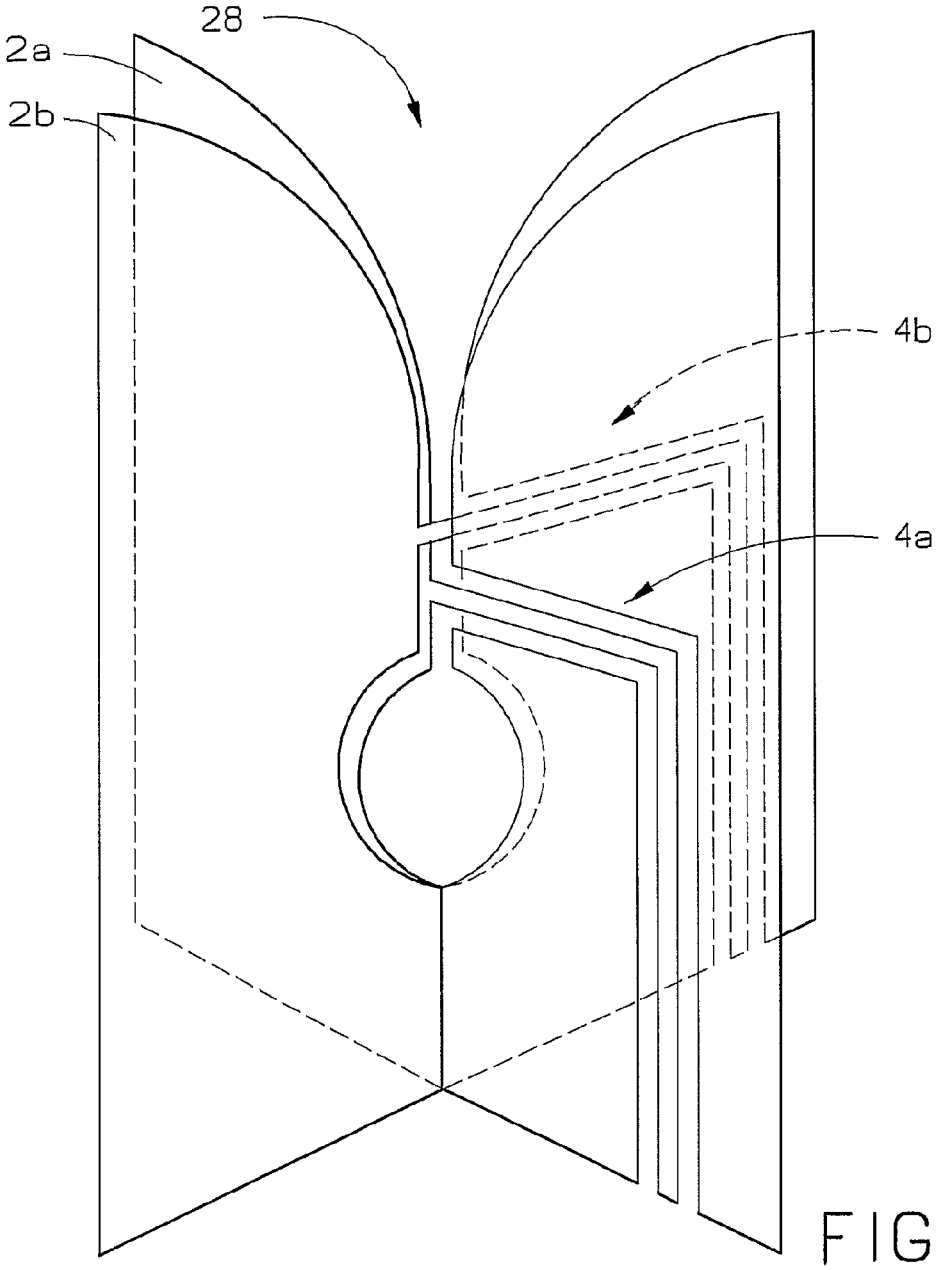
FIG. 8*a* shows a schematic perspective view of a dual polarized antenna element with feed lines according to the invention.
Figure 8B:
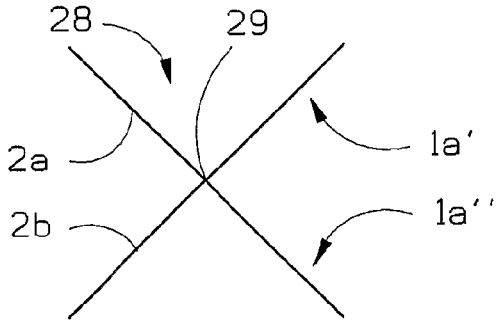
FIG. 8*b* shows a schematic top view of a dual polarized antenna element with feed lines according to the invention.

In FIGS. 8*a* and 8*b*, a dual polarized antenna 28 is shown. The dual polarized antenna element 28 comprises two orthogonally arranged antenna elements 1*a'* 1*a"*. The metal sheets 2*a*, 2*b* that constitute the dual polarized antenna 28 are here placed in such a way that they cross each other. Corresponding mounting slots (not shown) have to be made in the metal sheets in order to allow this placing. The mounting slots will be further discussed later. It is to be noted, however, that the feeding lines 4*a*, 4*b* will have to be separated vertically in order to avoid that the centre conductors 4*a*, 4*b* come in contact with each other in the intersection. Preferably, the crossing point 29, shown in the top view in FIG. 8*b*, is soldered together, in order to ensure a good electrical connection between the metal sheets 2*a*, 2*b*. The dual polarized antenna 28 radiates main lobes that are orthogonal relative to each other, and may also be fed in such a way that it radiates circular polarization.

Figure 9:
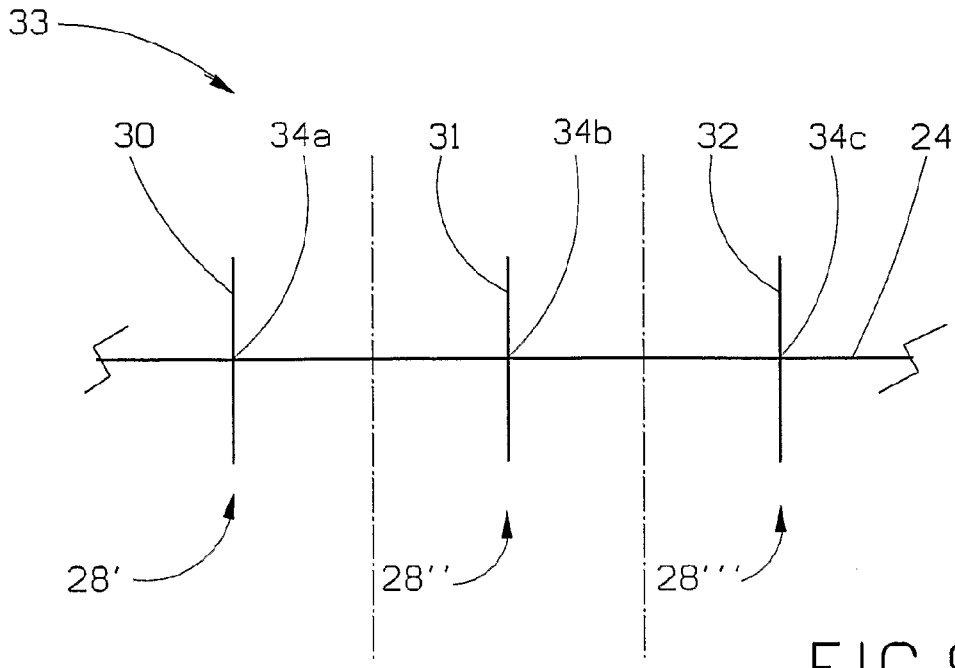
FIG. 9 shows a schematic top view of a dual polarized one-dimensional array antenna with feed lines according to the invention.

By adding orthogonal antenna elements 30, 31, 32 to the one-dimensional array antenna 24 shown in FIG. 6, a one-dimensional dual polarized array antenna 33 as shown in the top view in FIG. 9 is obtained. The antenna elements are thus arranged in orthogonal pairs 28', 28", 28'", according to the dual polarized antenna element shown in FIG. 8*a* and FIG. 8*b*, radiating in orthogonal directions. Corresponding mounting slots (not shown) have to be made in the metal sheets in order to allow this placing. The antennas 30, 31, 32 are placed in such a way that they cross each other. Preferably, the crossing points 34*a*, 34*b*, 34*c* are soldered together, in order to ensure a good electrical connection.

The indents 25*a-d* shown in FIGS. 6 and 7, are not shown in FIGS. 9-13. Due to the more stable structure due to the orthogonally placed antenna elements, the indents may be omitted in the above example and in the following examples.

Figure 10:
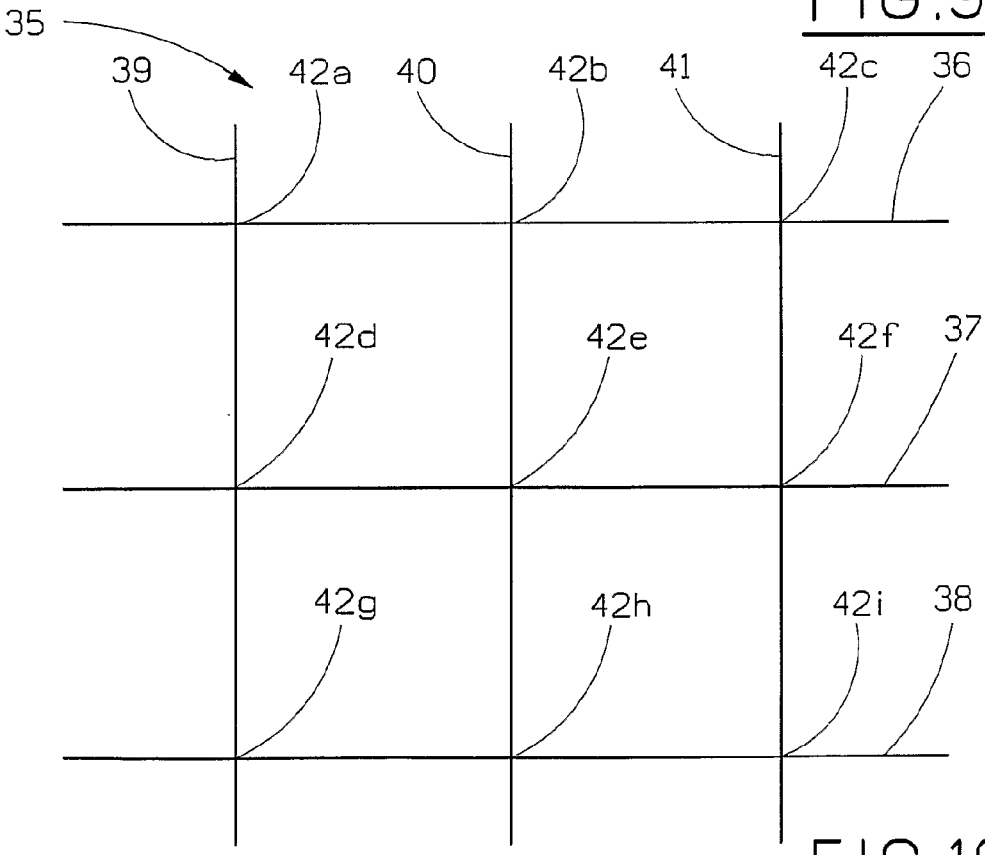
FIG. 10 shows a schematic top view of a dual polarized two-dimensional array antenna with feed lines according to the invention.

By orthogonally adding one-dimensional array antennas 24, according to the one shown in FIG. 6, to the two-dimensional array antenna 25 shown in FIG. 7, a two-dimensional dual polarized array antenna 35, as shown in the top view in FIG. 10 is obtained, i.e. the antenna elements are arranged in orthogonal pairs in two dimensions, radiating in orthogonal directions. The metal sheets 36, 37, 38; 39, 40, 41 are here placed in such a way that they cross each other, the crossing points 42*a*, 42*b*, 42*c*, 42*d*, 42*e*, 4*f*, 42*g*, 42*h*, 42*i* may be either between each antenna element, or in the middle of each antenna element. Corresponding mounting slots (not shown) have to be made in the metal sheets in order to allow this placing. Preferably, the crossing points 42*a*, 42*b*, 42*c*, 42*d*, 42*e*, 42*f*, 42*g*, 42*h*, 42*i* are soldered together, in order to ensure a good electrical connection.

Figure 11A:
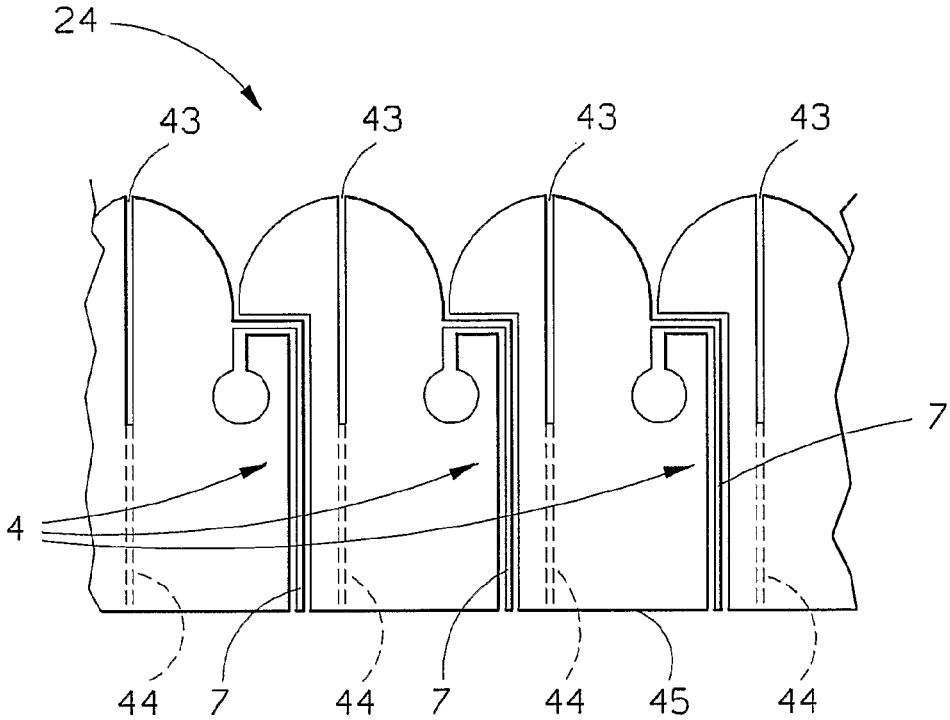
FIG. 11*a* shows a schematic front view of a first one-dimensional array antenna with slots.
Figure 11B:
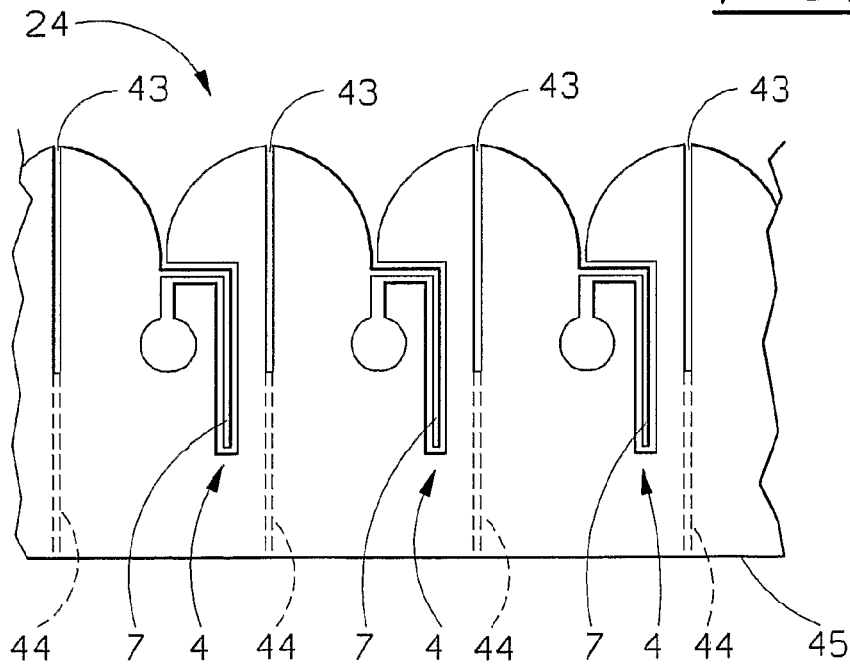
FIG. 11*b* shows a schematic front view of a second one-dimensional array antenna with slots.

A one-dimensional array antenna 24, equipped with mounting slots 43, 44 as discussed above, is shown in two different embodiments in FIG. 11*a* and FIG. 11*b*. The mounting slots 43 of one array antenna row are shown with a continuous line, and the mounting slots 44 of a corresponding array antenna row are shown with a dotted line. The array antenna rows with dotted line mounting slots 44 are placed orthogonally onto the array antenna rows with continuous line mounting slots 43, allowing the slots 43, 44 to grip into each other. The slots 43, 44 may also be made in the middle of each tapered slotline 3 (not shown), but then the feeding lines 4 will have to be separated vertically in order to avoid that they come in contact with each other in the intersection as described above with reference to FIGS. 8*a* and 8*b*.

In FIG. 11*a*, the centre conductors 7 of the CPW feed lines 4 run to the edge 45 of the metal sheet. In FIG. 11*b*, the centre conductor 7 of the CPW feed line 4 stops before it reaches the edge 45 of the metal sheet. The latter configuration will be discussed further below. It is to be noted, however, that the embodiment according to FIG. 11*b* does not result in separate metal parts that have to be retained in relation to each other in some appropriate way, but instead results in a coherent structure.

Figure 12:
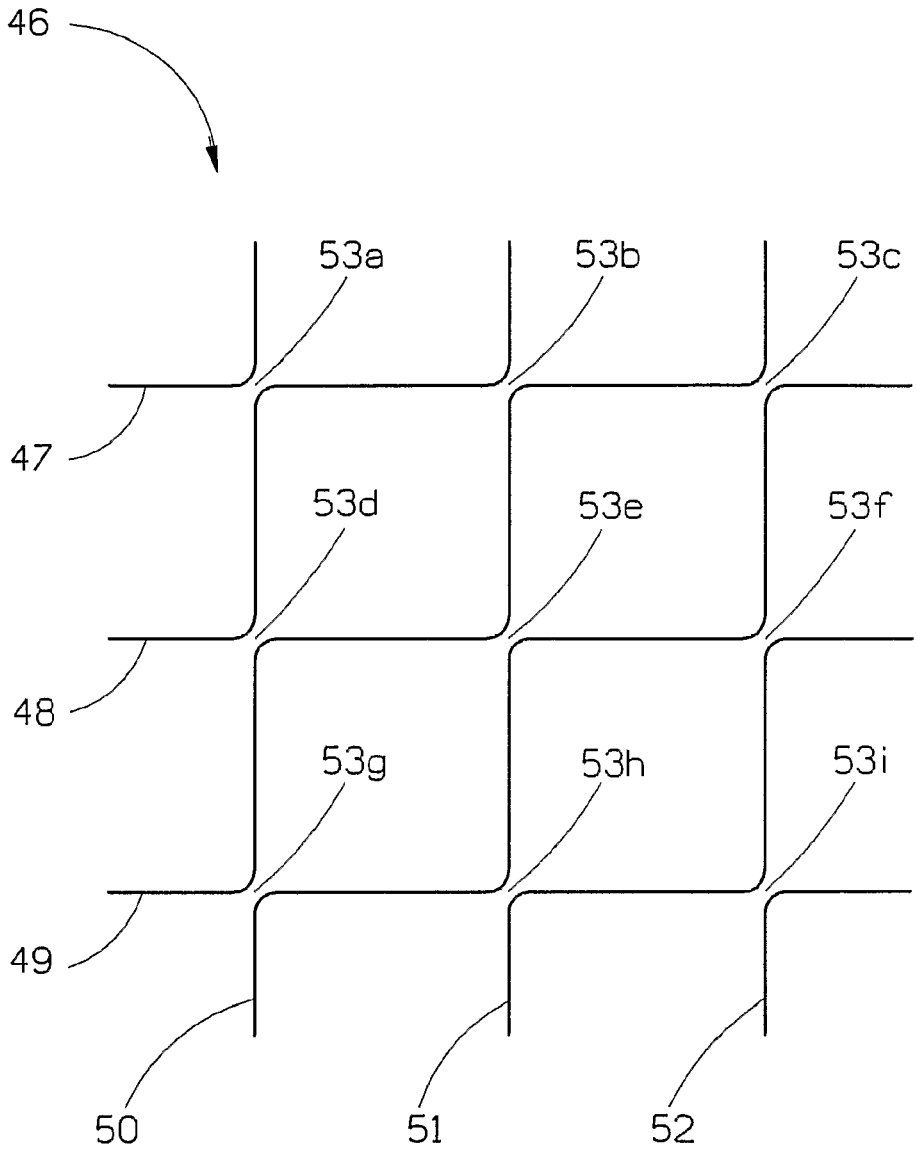
FIG. 12 shows a second embodiment schematic top view of a second embodiment of the dual polarized two-dimensional array antenna according to FIG. 10.

In FIG. 12, another dual polarized two-dimensional antenna array 46 is shown. Punched metal sheets 47, 48, 49, 50, 51, 52 are here arranged in a zigzag pattern, and are arranged in such a way that an arrangement similar to the embodiment according to that in FIG. 10 is obtained. The crossing points 53*a*, 53*b*, 53*c*, 53*d*, 53*e*, 53*f*, 53*g*, 53*h*, 53*i* are here positioned between the foldings in the zigzag pattern, which foldings and crossing points 53*a*, 53*b*, 53*c*, 53*d*, 53*e*, 53*f*, 53*g*, 53*h*, 53*i* may be positioned either between each antenna element or in the middle of each antenna element. Preferably, the crossing points 53*a*, 53*b*, 53*c*, 53*d*, 53*e*, 53*f*, 53*g*, 53*h*, 53*i* are soldered together, in order to ensure a good electrical connection.

All these antenna elements in the dual polarized embodiments described above are, as in the previous single polarized cases, connected to an external feeding 19, 20 via appropriate connections, where the external feeding 19, 20 may be a distribution net which may comprise means adapted for reception and/or transmission, for example a so-called T/R module (transmit/receive module), that may be of an active or a passive type. The feeding 19, 20 may also comprise variable phase-shifters and power attenuators. The feeding 19, 20 may be connected to a control unit (not shown) for power and phase control. The antenna elements 1*a*, 1*a'*, 1*a"*, 1*b*, 1*c*, 30, 31, 32 in the antenna array 24, 24', 33, 35, 46 columns and rows may thus be fed in such a way that the main lobe of the array antenna radiation pattern may be directed in different directions along the array columns and rows for each one of the two polarizations. The antenna elements in the dual polarized embodiments described above may also be fed in such a way that circular polarization is obtained.

Figure 13A:
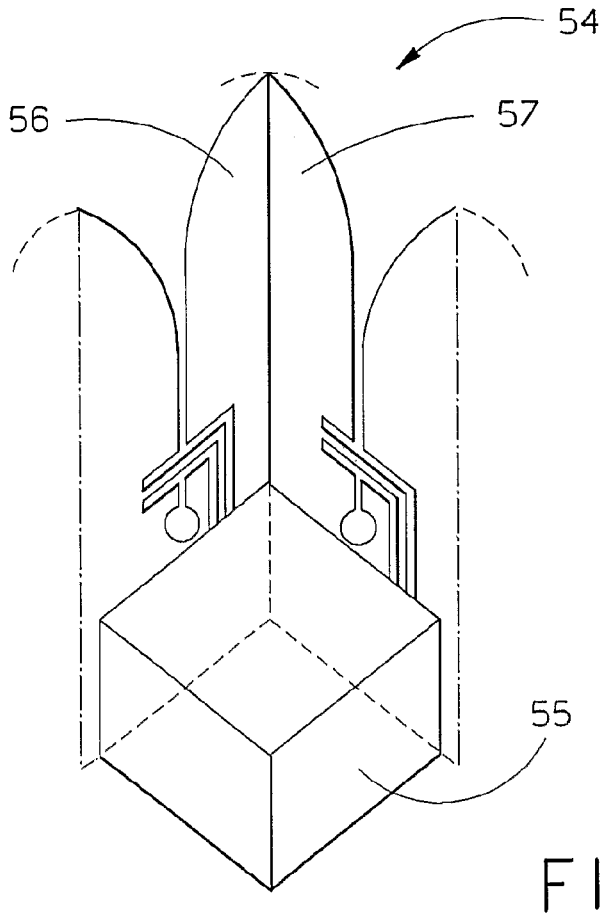
FIG. 13*a* shows a schematic perspective view of a dual polarized two-dimensional array antenna connected to a feeding module.
Figure 13B:
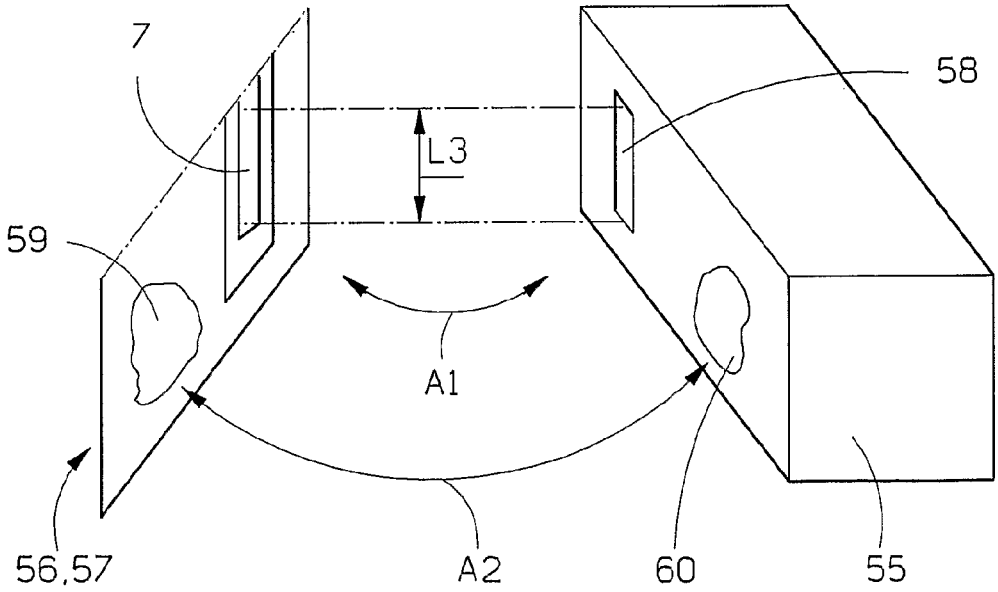
FIG. 13*b* shows a separated version of the view in FIG. 13*a;*

FIG. 13*a* and FIG. 13*b* disclose one possibility to feed a dual polarized array antenna 54 according to FIG. 10 or FIG. 12 having centre conductors 7 according to FIG. 11*b*, not extending all the way down to the edge 45 of the metal sheet. In FIG. 13*b*, the structure is shown separated, as indicated with arrows A1 and A2. An insertion feeding module 55, essentially cubic or shaped as a rectangular parallelepiped, fitting into the space formed by the surrounding antenna 54 elements 56, 57, is placed in each such space formed by the array antenna 54 grid pattern. The insertion feeding module 55 is adapted for reception and/or transmission and may for example may be of an active or a passive type. The insertion feeding module 55 may also comprise a feeding network, variable phase-shifters and power attenuators. The insertion feeding module 55 may be connected to a control unit for power and phase control (not shown). The insertion feeding module 55 has at least one coupling conductor 58 for connecting the antenna element 56, 57 centre conductor 7, where the coupling conductor 58 has the length L3 which essentially equals $\lambda_g/4$, enabling a reliable connection to be achieved. Having the length $\lambda_g/4$ of the coupling conductor 58 results in that there does not have to be a perfect galvanic contact between the coupling conductor 58 and the corresponding centre conductor 7. The antenna element centre conductor 7 in FIG. 11*b* is shown open ended, but may be short-circuited if it is compensated for in the coupling.

If the insertion feeding module 55 dissipates heat, for example as active components gets warm when in use, the antenna structure 54 may be used as a cooling flange for the insertion feeding modules 55. Then certain corresponding areas 59, 60 may be chosen for heat transfer from the insertion modules to the antenna structure. These areas are preferably coated with a heat-conducting substance of a known kind.

Being used in a dual polarized antenna 54 as shown in FIG. 13*a*, each insertion feeding module 55 have two coupling conductors (not shown), feeding two antenna elements 56, 57 with different polarizations. This kind of feeding of the antenna elements 56, 57 with coupling conductors 58 coupling to a centre conductor 7 may be applied for other embodiments of the invention as well. The insertion feeding modules 55 used in the array antenna 54 may also be arranged for feeding the antenna elements 56, 57 in such a way that circular polarization is obtained.

It is to be understood that the plane against which the insertion feeding modules rest, is no ground plane. The plane may be equipped with appropriate connectors that connect each insertion feeding module 55 to its feeding, for example comprising RF, power and/or control signals (not shown).

The invention will not be limited to the embodiments discussed above, but can be varied within the scope of the appended claims. For example, the indents 24*a*, 24*b*, 24*c*, 24*d* of the array antenna metal sheets may be arranged and shaped in many way, the one indent design shown is only one example among many.

Further, the array antenna configuration according to FIG. 6 may be made without the retainers 14*a*, 14*b*, 14*c* shown in FIG. 4, as the separate metal parts 21*a*, 21*b*, 21*c*, 21*d* making up the array antenna 21 may be individually fastened to the external feeding 19 in an appropriate way, for example by means of gluing. Additional stabilizing is also added by means of the connectors 15, 18.

The array antennas 24, 24', 33, 35, 46, 54 described above may be additionally supported by placing an appropriate supporting material between the metal sheet or metal sheets forming the array antenna. Such a material would preferably be of a foam character, such as polyurethane foam, as it should be inexpensive and not cause losses and disturb the radiation pattern.

Different feeding modules 19, 20, 55 have been discussed. Other ways to connect active or passive feeding modules to the antenna elements are conceivable within the scope of the invention.

The slot form of the antenna elements may vary, the tapered slot 6 may have different shapes, it may for example be widened in steps. The first part 3*a* of the slot may end in many ways, for example the mentioned two-dimensional cavity 5 or a short-circuit to the metal sheet layer 2 at a suitable distance from the feed point 10.

The manufacturing of the antenna elements may be performed in many ways, punching has been mentioned above. Other examples are laser-cutting, etching, machining and water-cutting. If the manufactured antenna will consist of a plurality of separated parts, these parts may first be connected by small connecting bars, allowing easy handling. When the antenna is correctly and safely mounted, these small bars may be removed.

In another embodiment, not illustrated, the antenna structure may be etched from a piece of substrate, for example a PTFE-based substrate. The metal is completely removed from one side of the substrate and the metal on the other side then constitutes the antenna element. Another similar piece of substrate without metal on both sides is also used, where the antenna element is squeezed between the two substrates. The piece of substrate without metal is used to create symmetry. As there is only one metal layer, no parallel-plate modes will be created.

In all the embodiments shown above, the characteristic impedance of the CPW feeding line 4 will be determined by the width of the centre conductor 7, the width of the slotline 3 and the thickness of the metal sheet 2. The slotline is preferably essentially straight, but may also be slightly tapered.

Figure 14A:
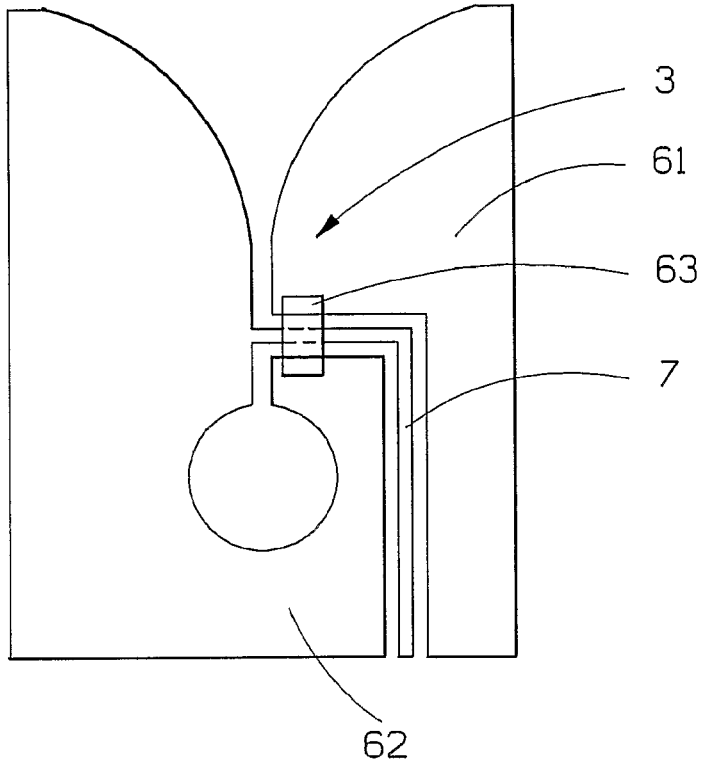
FIG. 14*a* shows a schematic front view of a first embodiment of an antenna element with a feed line according to the invention, where the feed line is equipped with a metal bridge.

As shown in FIG. 14*a*, the ground plane 2 comprises two separate ground planes 61, 62 surrounding the centre conductor 7 of a co-planar waveguide 4. As known in the art, these surrounding ground planes 61, 62 are preferably electrically connected near a feeding point, i.e. where the centre conductor 7 intersects the slotline 3. This is for example accomplished by means of at least one metal bridge 63 which is bent from a thin rectangular metal piece or a metal wire. The metal bridge 63 is soldered (or glued with electrically conducting glue) to the surrounding ground planes 61, 62 just before the slot 3, connecting the ground planes 61, 62 without making contact with the centre conductor 7.

Figure 14B:
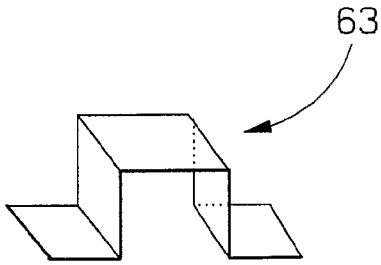
FIG. 14*b* shows a first variant of a metal bridge.
Figure 14C:
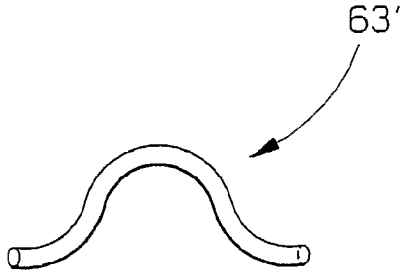
FIG. 14*c* shows a second variant of a metal bridge.

The metal bridge 63 may be bent into shape with sharp angles as shown in FIG. 14*b*, where the bridge 63 is bent from a rectangular metal piece. The metal bridge may also be bent more softly, following a more or less semi-circle line 63', as shown in FIG. 14*c*, where the bridge 63' is bent from a metal wire. Of course, it is possible to use either only one metal bridge on one of the sides, or one metal bridge at each side. The latter is preferred, since the electrical connection then is ensured to a higher degree, and the symmetry is undisturbed.

Figure 15:
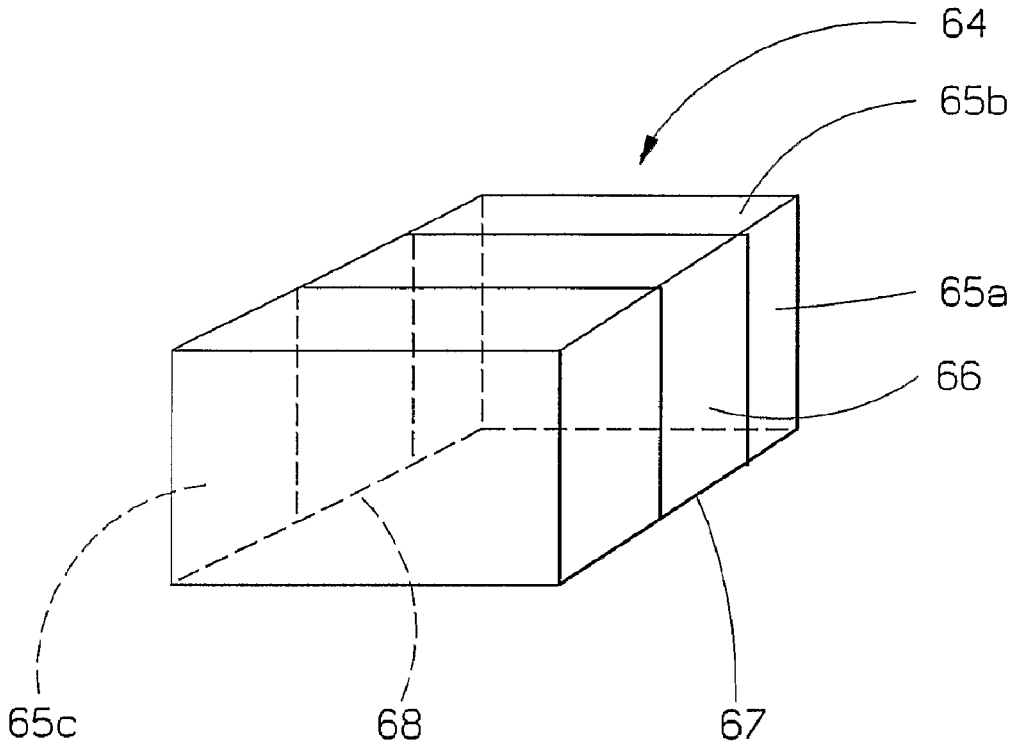
FIG. 15 shows a metal bridge formed on a dielectric material.

With reference to FIG. 15, one alternative of how to accomplish a metal bridge according to the above, is to use a piece of dielectric material 64, preferably having a box-shape with essentially perpendicular sides. Along three succeeding sides 65*a*, 65*b*, 65*c* of the dielectric material 64, a copper foil conductor 66 runs, forming a "U", thus having two edges 67, 68 which are brought into electrical contact with the surrounding ground planes 61, 62 in FIG. 14*a* by means of for example soldering or gluing with electrically conducting glue. The conductor 66 may be formed by means of for example etching, milling or screen-printing.

The metal bridges 63, 63', 64 described above are only examples of how a metal bridge may accomplished, the important feature is that the ground planes 61, 62 surrounding the centre conductor 7 of the co-planar waveguide 4 are brought into electrical contact with each other in the vicinity of the feeding point, i.e. the slot. The metal bridge or bridges used should, however, interfere with the co-planar waveguide structure as little as possible.

The metal bridges 63, 63', 64 according to the above should preferably be used for all embodiments described, for those where the centre conductor of the co-planar waveguide passes the slot and continues (for example the embodiments according to FIGS. 2 and 3), metal bridges should be used both before and after the slot, then preferably resulting in totally four metal bridges, two on each side.

The tapered slot antenna described in the embodiments may be of the type Vivaldi notch element. Other types of antenna elements which may be made in a single metal layer and fed by a feeding line according to the invention are conceivable, for example a dipole antenna of a previously known type.

The invention claimed is:

1. A broadband non-resonant antenna device for wireless transmission of information using electromagnetic signals, comprising a metal sheet layer, forming a plane, with a slotline that comprises a first part and a second part, where the side of the second part that is the most distant from the first part transcends into a widening open-ended tapered slot in the metal sheet layer, where the device additionally comprises a feeding line in the metal sheet layer, which feeding line comprises a feeding part, with a first end and a second end, and gaps separating the feeding part from the surrounding metal sheet layer by a certain distance, where the slotline is intersected by the feeding line wherein the antenna device is made from a sheet of metal, forming the metal sheet layer.

2. Antenna device according to claim 1, wherein the feeding part divides the slotline into the first part and the second part of the slotline.

3. Antenna device according to claim 1, wherein the first end of the feeding part is connected to the metal sheet layer after having intersected the slotline.

4. Antenna device according to claim 1, wherein the tapered slot has an exponential form.

5. Antenna device according to claim 1, wherein the side of the first part of the slotline that is the most distant from the second part transcends into an essentially two-dimensional cavity.

6. Antenna device according to claim 5, wherein the essentially two-dimensional cavity has a circular form.

7. Antenna device according to claim 1, wherein the side of the first part of the slotline that is the most distant from the second part is short-circuited to the metal sheet layer.

8. Antenna device according to claim 1, wherein the first end of the feeding part is positioned past the slotline, with the gaps continuing at each of the sides of the feeding part.

9. Antenna device according to claim 8, wherein the gaps are joined at the first end of the feeding part.

10. Antenna device according to claim 9, wherein the joining part of the gaps, at the first end of the feeding part, forms an essentially two-dimensional cavity.

11. Antenna device according to claim 1, wherein the second end of the feeding part extends to an edge of metal sheet layer.

12. Antenna device according to claim 1, wherein an external feeding is attached to the second end of the feeding part.

13. Antenna device according to claim 1, wherein a electrical contact is obtained between those ground planes that surround a centre conductor near the position where the centre conductor intersects the slotline.

14. Antenna device according to claim 13, wherein said electrical contact is obtained by means of a metal bridge.

15. A broadband non-resonant array antenna comprising a plurality of similar antenna devices, for wireless transmission of information using electromagnetic signals, wherein at least one of the included antenna devices has the features described in claim 1.

16. Array antenna according to claim 15, wherein the antenna devices are positioned beside each other on the metal sheet layer.

17. Array antenna according to claim 16, wherein a plurality of metal sheet layers, comprising the antenna devices positioned beside each other, are placed in a plurality of rows.

18. Array antenna according to claim 15, wherein for each included antenna device, one orthogonally arranged antenna device is arranged.

19. Array antenna according to claim 15, wherein a external feeding comprises at least one feeding module of an active or a passive type connected to at least one of the antenna devices.

20. Array antenna according to claim 19, wherein the at least one feeding module comprises a variable phase-shifter and/or power attenuators.

21. Array antenna according to claim 19, wherein the at least one feeding module may be connected to a control unit for power and phase control.

22. Array antenna according to claim 19, wherein the at least one feeding module is electromagnetically coupled to at least one of the antenna devices.

23. Array antenna according to claim 19, wherein the at least one feeding module is arranged to feed the at least one antenna device in such way that circular polarization is obtained.

* * * * *

UNITED STATES PATENT AND TRADEMARK OFFICE

CERTIFICATE OF CORRECTION

PATENT NO. : 7,403,169 B2
APPLICATION NO. : 10/584907
DATED : July 22, 2008
INVENTOR(S) : Svensson et al.

It is certified that error appears in the above-identified patent and that said Letters Patent is hereby corrected as shown below:

In Column 7, Line 23, delete “4f,” and insert -- 42f, --, therefor.

Signed and Sealed this

Twenty-first Day of April, 2009

JOHN DOLL
*Acting Director of the United States Patent and Trademark Office*